US011534938B2

(12) United States Patent
Gozzi et al.

(10) Patent No.: US 11,534,938 B2
(45) Date of Patent: Dec. 27, 2022

(54) LEVELLING DEVICE FOR MATERIALS IN POWDER OR GRANULE FORM

(71) Applicant: SYSTEM CERAMICS S.P.A., Fiorano Modenese (IT)

(72) Inventors: Franco Gozzi, Formigine (IT); Ivan Ghirelli, Castellarano (IT); Franco Stefani, Sassuolo (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 76 days.

(21) Appl. No.: 17/050,907

(22) PCT Filed: Apr. 19, 2019

(86) PCT No.: PCT/IB2019/053265
§ 371 (c)(1),
(2) Date: Oct. 27, 2020

(87) PCT Pub. No.: WO2019/211696
PCT Pub. Date: Nov. 7, 2019

(65) Prior Publication Data

US 2021/0229316 A1 Jul. 29, 2021

(30) Foreign Application Priority Data

May 4, 2018 (IT) ..... 102018000005064

(51) Int. Cl.
*B28B 13/02* (2006.01)
*B30B 15/30* (2006.01)

(52) U.S. Cl.
CPC ..... *B28B 13/0295* (2013.01); *B30B 15/308* (2013.01)

(58) Field of Classification Search
CPC .... B30B 15/308; B28B 5/027; B28B 13/0295
See application file for complete search history.

(56) References Cited

U.S. PATENT DOCUMENTS 3,002,834 A * 10/1961 Renato ..... H01M 4/0404 428/614
4,379,729 A * 4/1983 Cross ..... B28B 1/522 156/73.6
6,702,966 B1 * 3/2004 Suzuki ..... B28B 1/29 425/371
2004/0251582 A1 * 12/2004 Morandi ..... B28B 13/022 264/650

FOREIGN PATENT DOCUMENTS

EP 2152484 B1 5/2011
WO 2008123005 A2 10/2008

* cited by examiner

*Primary Examiner* — Kelly M Gambetta
*Assistant Examiner* — Virak Nguon
(74) *Attorney, Agent, or Firm* — Pearne & Gordon LLP

(57) ABSTRACT

Levelling device for materials in powder or granule form, comprising: a rest plane (2), mobile in advancement along a longitudinal direction (X) and predisposed to transport a layer (L) having a thickness (S) of material in powder or granule form. The device comprises a leveller (5,6), positioned above the rest plane (2).

16 Claims, 2 Drawing Sheets

LEVELLING DEVICE FOR MATERIALS IN POWDER OR GRANULE FORM

The present invention relates to a levelling device for materials in powder or granule form.

In a preferred but not exclusive manner, the levelling device according to the present invention can be used in systems for pressing ceramic tiles or slabs.

The invention relates in particular to systems for pressing ceramic slabs of large dimensions. These systems substantially envisage the pressing of a layer of soft material previously spread on a conveyor plane that, for at least a section of its path, passes through a press.

The spreading of the material is often irregular because of difficulties related to managing the motion of the powder conveyor plane, due to the irregularity of the plane itself caused by vibrations and oscillations of the system. Even if the thickness of the deposited layer is constant, in any case a more precise adjustment does not allow avoiding the formation of streaks or depressions on the surface of the deposited layer, or differences in the density of the layer of soft material.

The aim of the present invention is to offer a levelling device that makes it possible to overcome the limits and drawbacks of the known devices.

One advantage of the device according to the present invention is that it allows the spreading of a layer of soft material that is homogeneous and of constant thickness, regardless of the advancement velocity of the conveyor plane or the irregularities of the surface itself or the vibrations or oscillations of the system.

Another advantage of the device according to the present invention is that it produces a layer whose surface is free of irregularities.

Further characteristics and advantages of the present invention will become more apparent in the following detailed description of an embodiment of the present invention, illustrated by way of non-limiting example in the attached figures, wherein.

The levelling device according to the present invention comprises a rest plane (2), mobile in advancement along a longitudinal direction (X). Both the rest plane (2) and the longitudinal direction (X) are preferably horizontal.

In a preferred, non-exclusive embodiment, the rest plane (2) comprises a motorised belt which is slidable along a predetermined path that has a main section parallel to the longitudinal direction (X).

Figure 1:
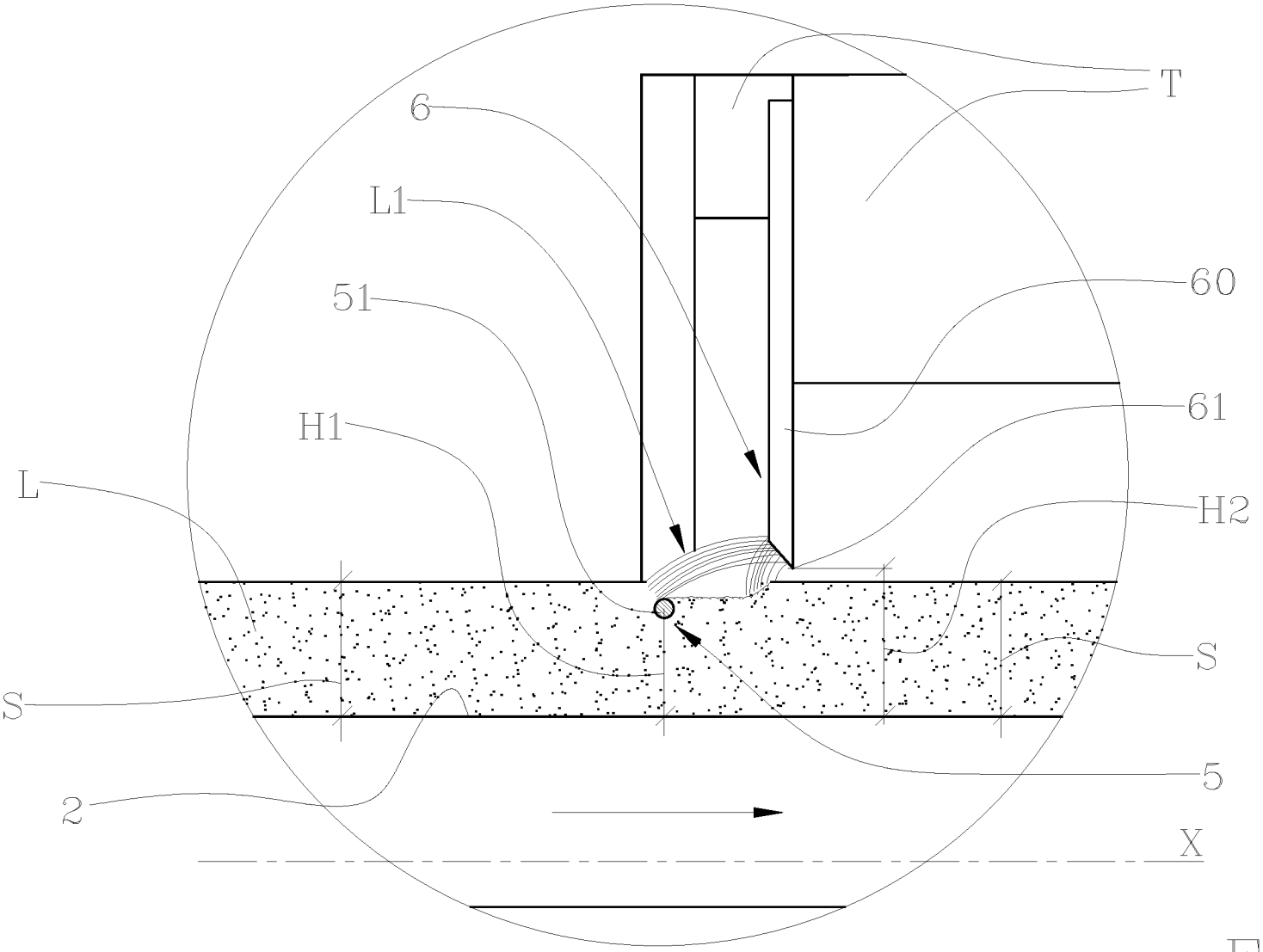
FIG. 1 shows a schematic view of the levelling device according to the present invention.
Figure 2:
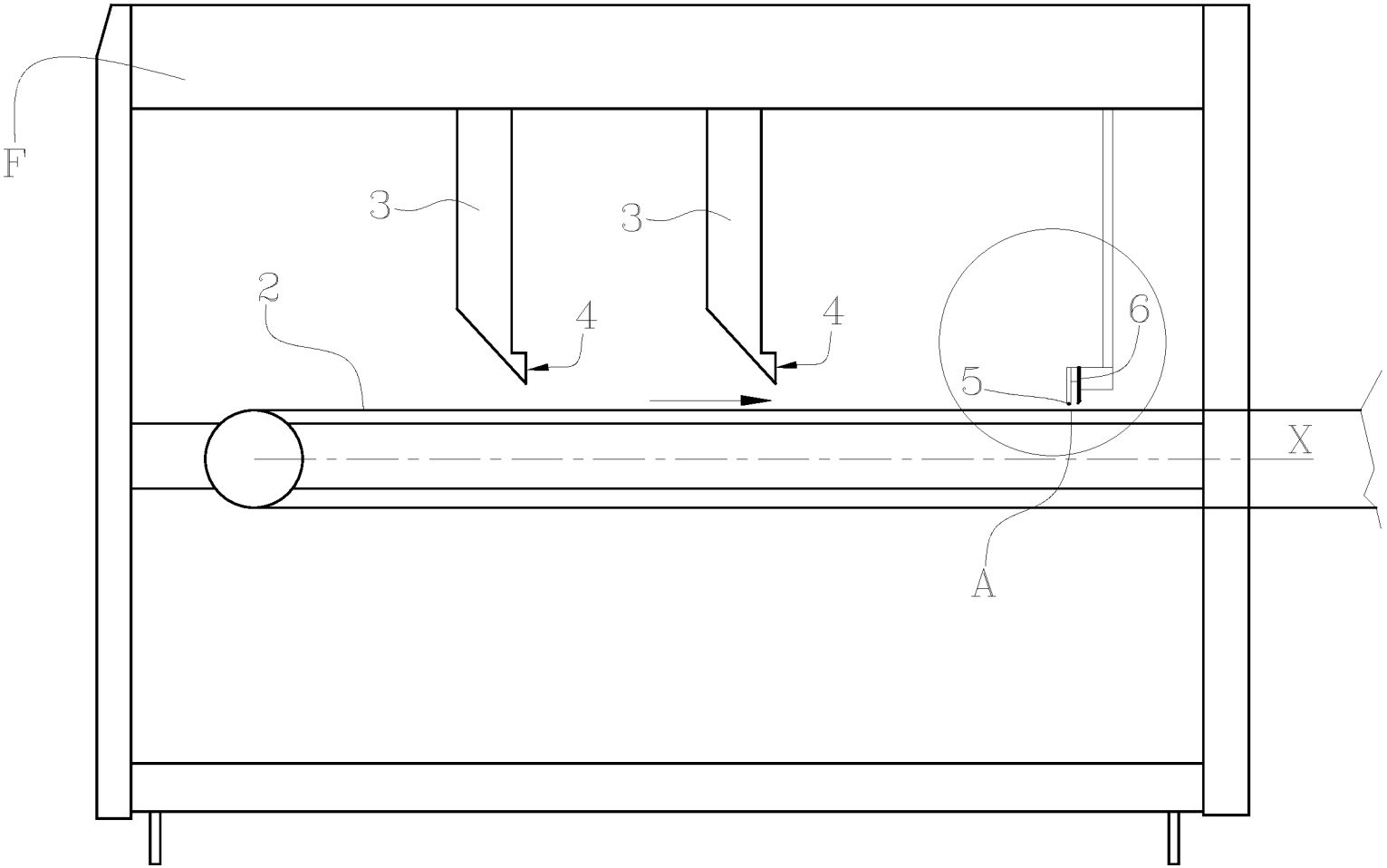
FIG. 2 shows a possible embodiment of a spreading device that uses a levelling device according to the present invention.

The deposit of a layer (L) of a material in powder or granule form on the rest plane (2) can be carried out, for example, by means of a feeding device known in the art, which comprises, for example, at least one hopper (3), arranged above the rest plane (2) and equipped with a discharge opening (4), positioned at a predetermined height above the rest plane (2), as shown in FIG. 1. The hopper (3) contains the soft material, in powder or granule form, intended to be spread on the rest plane, to be fed to a press. The discharge opening (4) is structured to allow the descent by gravity and the fall of the material on the rest plane (2). A closure device is associated with the hopper (3) to allow the controlled opening and closing of the discharge opening (4). The hopper (3) will not be described in further detail, as it is a known device in the field.

In a possible alternative embodiment, the rest plane (2) is stationary, while the feeding device is mobile with respect to the rest plane (2) along the longitudinal direction (X).

The soft material, spread on the rest plane with the device briefly described above, or with other known techniques in the field, is arranged in a continuous or discontinuous layer (L) of thickness (S). Thickness (S) is substantially intended as the height of the surface of the layer (L) with respect to the rest plane (2).

The levelling device according to the present invention comprises a leveller (5,6), positioned above the rest plane (2).

The leveller (5,6) is provided with a first element (5), arranged at a first height (H1) that is lower than the thickness (S) of the layer (L). The first element (5) is arranged to interfere with a surface layer (L1) of the layer (L), or with an upper layer of the layer (L). The first element (5) is further arranged to raise the surface layer (L1) to a height that is greater than the thickness (S) thereof.

The leveller (5,6) is further provided with a second element (6), positioned downstream of the first element (5) with respect to the advancement direction and placed at a second height (H2). The second height (H2) is greater than or equal to the first height (H1).

Preferably the second height (H2) is also greater than or equal to the thickness (S) of the layer (L). More preferably, the second height (H2) is greater than the thickness (S) of the layer (L).

The first element (5) is substantially arranged to interfere with a surface layer (L1) of a predetermined thickness of the layer (L) and to rise such surface layer (L1) above the thickness (S).

The device according to the present invention is predisposed to create a relative motion along the longitudinal direction (X) between the rest plane (2) and the leveller (5,6).

Preferably, the layer (L) is brought forward from the rest plane (2) at a velocity suitable to produce a projection or diversion upwards of the surface layer (L1), when the latter comes into contact with the first element (5). In substance, by coming into contact with the first element (5) at a given velocity, the material of the surface layer (L1) is diverted upwards, assuming a velocity directed along a direction which is inclined upwards at a certain angle. This also applies in the case wherein the rest plane (2) is stationary and the leveller (5,6) is translated horizontally along the longitudinal direction (X) with respect to the rest plane (2).

In addition to rising the surface layer (L1), the first element (5) also performs the action of turning and/or unseating an upper layer of the layer (L), or the surface layer (L1), the thickness of which can be adjusted by varying the height of the first element (5). In substance, the first element (5) moves the surface layer (L1), rendering its compactness homogeneous and breaking up any lumps or accumulations that have been further compacted between them.

The first element (5) is structured in such a way as to not retain, or retain only a limited quantity, of surface material of the layer (L), substantially without forming an accumulation of material. To this end, the first element (5) preferably has a limited thickness in the direction perpendicular to the rest plane (2).

As already indicated, by coming into contact with the first element (5) at a given velocity, the material of the surface layer (L1) is diverted upwards, assuming a velocity directed along a direction which is inclined upwards at a certain angle. In the absence of the second element (6), the material of the surface layer (L1) would follow a parabolic trajectory and would be again deposited on the underlying layer (L). In the present invention, before depositing on the layer (L) again, the material of the surface layer (L1) meets the second element (6) and is levelled downwards from the second element (6) which renders its thickness perfectly uniform. In fact, the second element (6) operates on a surface layer which has been shaken and made less compact by the first element (5). The second element (6) distributes the material in a uniform manner and smooths the surface layer (L1) raised by the first element (5), defining a flat surface free of significant irregularities for the subsequent pressing.

The second height (H2) of the second element (6) is also greater than or equal to the thickness (S) of the layer (L). Preferably, the second height (H2) is greater than the thickness (S), and is such as to intercept the surface layer (L1) projected or diverted upwards from the first element (5). The second element (6) equalises and redistributes the material of the surface layer (L1), previously raised by the first element (5). This makes it possible to obtain, downstream of the leveller (5,6), a constant thickness of the layer (L), substantially equal to the thickness (S) of the layer (L) upstream of the leveller (5,6) and a flat and uniform surface. Part of the surface material that comes into contact with the second element (6) is distributed in a transverse direction with respect to the longitudinal direction (X), equalising and compensating all the surface irregularities of the layer (L).

In one possible embodiment, illustrated in FIG. 1, the first element (5) comprises a wire-shaped element (51). The wire-shaped element is arranged on a substantially horizontal plane, parallel to the rest plane (2). The wire-shaped element (51) can be supported at its ends by two fixed supports, associated for example with the supporting frame of the rest plane (2), or, in the version wherein the leveller (5,6) is mobile, with a frame that is mobile with respect to the rest plane (2).

The wire-shaped element (51) can have the shape of a steel bar or wire, the shape of a cable or of a thin sheet or other still.

In one possible embodiment, the second element (6) comprises a lower edge (61), positioned at the second height (H2) above the rest plane (2). For example, the second element (6) comprises a barrier (60) equipped with a lower edge (61), positioned at the second height (H2). The barrier (60) intercepts and redistributes the material of the surface layer (L1) projected upwards from the contact with the first element (5). Downstream of the lower edge (61), the layer of soft material has a constant thickness and a flat surface free of irregularities. Preferably, but not necessarily, the barrier (60) lies on a plane whose inclination is adjustable with respect to a plane that is perpendicular to the rest plane (2). In other words, the barrier (60) can be tilted forward or backwards with respect to the advancement direction of the rest plane (2). The possibility to adjust the inclination of the barrier (60) makes it possible to adapt its action in relation to materials with different compositions and grain sizes, and/or to variations in the speed of the rest plane (2). The barrier (60) can be associated for example with the supporting frame of the rest plane (2), or, in the version wherein the leveller (5,6) is mobile, with a frame that is mobile with respect to the rest plane (2).

The first element (5) and the lower edge (61) of the second element (6) are horizontal, or they lie on horizontal planes. In one possible embodiment, the first element (5) and the lower edge (61) are arranged perpendicularly to the longitudinal direction (X). In another possible embodiment, the first element (5) and the lower edge (61) are inclined with respect to the longitudinal direction (X) on respective horizontal lying planes, with an inclination which is not perpendicular with respect to the longitudinal direction (X). An inclination which is not perpendicular to the longitudinal direction (X), or a diagonal inclination with respect to the longitudinal direction (X), favours the action of the first element (5) and the second element (6) in the creation of a flat surface free of significant irregularities on the surface layer (L1). In the embodiment illustrated herein, the first and second element (5,6) are associated with a supporting frame (T). The leveller (5,6) can be equipped with the possibility of translating in a direction perpendicular to the rest plane (2), to allow the adjustment of the first and of the second height (H1,H2). Means for adjusting which are available to a person skilled in the art can be used to allow the displacement of the leveller (5,6) in a direction perpendicular to the rest plane (2) and/or to vary the orientation or inclination of the first element (5) and the lower edge (61) on the respective horizontal lying planes. Preferably, the first element (5) and the second element (6) are vertically and/or horizontally mobile independently from one another. For example, in the illustrated embodiment, the first and the second element (6) are slidable and lockable in position with respect to the supporting frame (T) independently from one another.

The leveller (5,6) can be further equipped with vibrating means. The use of vibrating means makes it possible to maintain fluid and uniformly distributed material. In particular, in the embodiment comprising the barrier (60), it is possible to arrange vibrating means which act on the barrier (60) itself. This makes it possible to uniformly distribute the material along the entire width of the layer (L).

The invention claimed is:

1. A levelling device for materials in powder or granule form, comprising: a rest plane (2), predisposed to receive at least a layer (L) of material in powder or granule form having a thickness (S); characterised in that:

- it comprises a leveller (5, 6) positioned above the rest plane (2);
- the rest plane (2) and the leveller (5, 6) are mobile in relation to one another along a longitudinal direction (X);
- the leveller (5, 6) is provided with a lifter (5) having a limited thickness in the direction perpendicular to the rest plane (2), the lifter (5) arranged at a first height (H1) that is lower than the thickness (S) of the layer (L), which is predisposed to interfere with the layer (L) so as to divide the layer into a base layer and a surface layer (LI) and to lift the surface layer (L1) away from the base layer to achieve a total height that is greater than the thickness (S) thereof;
- the leveller (5, 6) is provided with a distributor (6), positioned downstream of the lifter (5) and located at a second height (H2) so as to interfere with the lifted surface layer (L1) and to distribute the surface layer upon the base layer.

2. The device according to claim 1, wherein the second height (H2) is greater than or equal to the first height (H1).

3. The device according to claim 1, wherein the second height (H2) is greater than or equal to the thickness (S) of the layer (L).

4. The device according to claim 1, wherein the leveller (5, 6) is mobile at least in a direction that is perpendicular to the rest plane (2) to allow adjustment of the first height (H1) and the second height (H2).

5. The device according to claim 1, wherein the lifter (5) and the distributor (6) are mobile in a horizontal and/or vertical direction with respect to one another.

6. The device according to claim 1, wherein: the distributor (6) comprises a lower edge (61), positioned at the second height (H2) above the rest plane (2); the lifter (5) and the lower edge (61) lie on horizontal planes; the lifter (5) and the lower edge (61) are inclined with respect to the longitudinal direction (X) on the respective horizontal lying planes, with an inclination which is not perpendicular with respect to the longitudinal direction (X).

7. The device according to claim 1, wherein the leveller (5, 6) is equipped with vibrating means.

8. The device according to claim 1, wherein the distributor (6) comprises a barrier (60) equipped with a lower edge (61), positioned at the second height (H2) above the rest plane (2).

9. The device according to claim 8, wherein the barrier (60) lies on a plane the inclination of which is adjustable with respect to a plane that is perpendicular to the rest plane (2).

10. The device according to claim 1, wherein the first element (5) comprises a wire-shaped element (51).

11. The device according to claim 1, wherein the rest plane (2) is mobile along the longitudinal direction (X) and the leveller (5, 6) is stationary, or vice versa.

12. The device according to claim 1, wherein the lifter is configured as a suspended member which is held by opposite lateral ends and has a front portion, facing the layer, having a cross section with increasing thickness along the longitudinal direction so as to provide a gradual separation and lifting action on the base layer and surface layer.

13. The device according to claim 1, wherein the lifter has a circular cross section.

14. A method for spreading a layer of material in powder or granule form, comprising the following steps:

spreading a layer (L) having a thickness (S) of material in powder or granule form on a rest plane (2);

arranging a lifter (5), positioned at a first height (H1) that is lower than the thickness (S) of the layer (L);

arranging a distributor (6) at a second height (H2) that is greater than or equal to the first height (H1), the lifter and the distributor forming a leveller;

providing a relative sliding motion along a longitudinal direction (X) between the rest plane (2) and the leveller so that the lifter interferes with the layer and the lifter divides the layer into a surface layer (L1) of predetermined thickness and a base layer and lifts the surface layer away from the base layer, the surface layer passing above the lifter and the base layer passing below the lifter;

levelling the surface layer (L1) by means of the distributor (6), wherein the distributor interferes with the lifted surface layer and distributes the surface layer upon the base layer, the surface layer passing below the distributor to contact the base layer.

15. The method according to claim 14, wherein the step of dividing the layer into the surface layer (L1) and the base layer includes transporting the advancing layer (L) to be into contact with the lifter (5).

16. The method according to claim 14, wherein the step of dividing the layer into the surface layer (L1) and the base layer includes transporting the lifter (5) and the distributor (6).

* * * * *